US006073421A

United States Patent [19]

Lee

[11] Patent Number: 6,073,421

[45] Date of Patent: Jun. 13, 2000

[54] APPARATUS AND METHODS FOR FORMING A MAILER WITH CONTAINED DOCUMENT FROM A SINGLE WEB

[75] Inventor: Robert W. Lee, Amherst, N.Y.

[73] Assignee: Moore U.S.A. Inc., Grand Island, N.Y.

[21] Appl. No.: 09/057,485

[22] Filed: Apr. 9, 1998

[51] Int. Cl.[7] ..... B65B 11/48; B31B 1/90

[52] U.S. Cl. ..... 53/206; 53/460; 493/216; 493/921

[58] Field of Search ..... 493/216, 921, 493/220, 320, 324, 375, 223, 248; 53/411, 466, 131.5, 569, 206, 460

[56] References Cited

U.S. PATENT DOCUMENTS

| | | | |
|---|---|---|---|
| 2,214,593 | 9/1940 | Mustin et al. . | |
| 2,847,915 | 8/1958 | Rapp . | |
| 3,511,435 | 5/1970 | Hewitt et al. . | |
| 3,665,817 | 5/1972 | Katz et al. | 493/216 |
| 3,808,768 | 5/1974 | Dobbs | 493/220 |
| 4,071,997 | 2/1978 | Gunther, Jr. et al. . | |
| 4,085,560 | 4/1978 | McCloskey . | |
| 4,091,596 | 5/1978 | Jones | 493/230 |
| 4,205,504 | 6/1980 | Gregoire et al. . | |
| 4,312,169 | 1/1982 | Golicz et al. | 53/206 |
| 4,464,878 | 8/1984 | Golicz et al. . | |
| 4,668,212 | 5/1987 | Kotani | 493/216 |
| 4,931,035 | 6/1990 | Schmidt | 493/216 |
| 4,939,888 | 7/1990 | Katz et al. | 53/411 |
| 5,005,337 | 4/1991 | Kluth | 53/206 |
| 5,058,873 | 10/1991 | Hewitt et al. . | |
| 5,167,739 | 12/1992 | Hutchinson et al. . | |
| 5,172,907 | 12/1992 | Kalisiak | 271/227 |
| 5,233,812 | 8/1993 | Coppola | 493/216 |
| 5,287,128 | 2/1994 | Doane et al. | 346/159 |
| 5,409,441 | 4/1995 | Muscoplat | 493/220 |
| 5,524,421 | 6/1996 | Nauheimer et al. | 53/460 |
| 5,640,831 | 6/1997 | Harrod et al. | 53/206 |
| 5,819,666 | 10/1998 | Ishikawa et al. | 53/411 |

FOREIGN PATENT DOCUMENTS 2080765 2/1982 United Kingdom .

*Primary Examiner*—John Sipos
*Assistant Examiner*—Steven Jensen
*Attorney, Agent, or Firm*—Nixon & Vanderhye PC

[57] ABSTRACT

A single web is printed in side-by-side relation with variable and non-variable information forming document and envelope web portions. The web is split longitudinally and the document web portion is cut to form discrete documents. Each document is folded about transverse foldlines to form a folded document and rotated 90° for registration with matching envelope portions on the envelope web. Glue lines are applied to the envelope web. The envelope web is then plow-folded along both margins to form first and second flaps overlying and containing the document within the envelope portion of the envelope web. The glue lines are sealed to one another and excess envelope web material between adjacent envelopes is removed whereby envelopes containing documents sealed within the envelopes and forming mailers are provided.

14 Claims, 2 Drawing Sheets

APPARATUS AND METHODS FOR FORMING A MAILER WITH CONTAINED DOCUMENT FROM A SINGLE WEB

TECHNICAL FIELD

The present invention relates to apparatus and methods for forming a mailer including a document sealed within an envelope from a single web of paper and particularly relates to apparatus and methods for printing variable and non-variable information on a web, folding documents formed from the web, enveloping the folded documents within the envelope, folding portions of the web and sealing the envelope about the document and forming a discrete mailer with the document contained therein.

BACKGROUND

Mailers typically include an envelope containing a document which is separate and apart from the envelope per se. The documents and envelopes frequently contain variable as well as non-variable information, i.e., generic and personalized information such as names and addresses for individual mailer recipients. Documents printed with variable and non-variable information are typically stuffed into mailers which, if the mailing envelopes contain variable information, must be matched with the variable information set forth in the documents. The matching and the stuffing of the documents into the envelopes is an expensive and time-consuming operation which, in the present invention, is automated.

DISCLOSURE OF THE INVENTION

According to the present invention, a single web of paper is printed with variable and/or non-variable information as necessary and desirable. The single web is automatically separated into discrete documents and an envelope web portion for receiving matching documents. Particularly, the web of paper is imaged with variable and/or non-variable types of information in side-by-side relation along the web representing respective document and envelope information. Preferably, matching indicia is provided on the respective document and envelope portions of the web such that the documents and envelopes can be later matched to one another. This is particularly important where variable information is imaged on both the document and envelope portions of the web which requires that the discrete documents are matched to corresponding envelope portions of the web before those envelope portions are folded about the document to form the mailer.

After printing, the paper web is then slit longitudinally in the direction of web travel to form document and envelope-forming webs. The document-forming web is cut into discrete documents which are then folded. The fold can be one of many different types of folds, such as a C-fold, a Z-fold or a bi-fold, the folding preferably being about foldlines extending transverse to the longitudinal direction of movement of the document web. After each document is folded, it is rotated. The folded rotated document and matching envelope portion of the envelope web are then brought into registration such that the variable information printed on the document and envelope portion match one another.

With the folded document registered on a matching envelope portion, an adhesive is applied crosswise of the envelope web between the documents thereon. The envelope web is then folded, preferably plow-folded, adjacent one side of the document to form a first envelope flap to contain the document within the folded envelope web. The opposing ends of the first envelope flap containing the transverse adhesive strip lie in registration with end portions of the envelope web longitudinally beyond the ends of the document. After folding the first envelope flap, an adhesive is applied to either the folded flap or along an opposite side of the envelope web. A second envelope flap adjacent an opposite side of the document is folded over the document and over part of the first envelope flap. The flaps of the envelope portions are adhered to one another and the opposite ends of the envelope portions are adhered to one another. Preferably, the flaps and end portions are adhered by adhesive previously applied to the web, i.e., preexisting on the roll or during the process of cutting the web and folding the documents. With the envelope portions of the web containing the document being sealed, the envelope web is then severed at its opposite ends.

Because the document and envelope web portions are longer in the longitudinal direction of web travel than in a transverse direction, the envelope portions of the envelope web may have a longitudinal extent much greater than necessary and beyond envelope profile dimensions maintained by postal regulations. For example, where the side-by-side envelope and document portions are 8½×11, an envelope length of only 9.75 inches ±1/32 inch is required to enclose an 8½×11 C-folded document with a b ½-inch area on the leading and trailing edge for glue seams. Consequently, a 1.25-inch chip is cut and removed from the 11-inch length of the envelope portion by a double-bladed rotary cutter. Preferably, the transverse adhesive between envelope portions is applied in two strips spaced longitudinally from one another a distance corresponding to the necessary reduction in length of the envelope, i.e., corresponding to the longitudinal extent of the chip removed from between the discrete mailers.

In a preferred embodiment according to the present invention, there is provided a method for forming a mailer with a document contained therein from a single web of paper advancing in a longitudinal direction, comprising the steps of imaging indicia in side-by-side relation along the web representing respective document and envelope information, providing marks on the respective sides of the web for identifying matching documents and envelope portions on the web, slitting the web in the longitudinal direction to form document and envelope webs, respectively, with the envelope web carrying the envelope portions, cutting the document-forming web into discrete documents, folding the documents, registering the documents and envelope web with one another, determining a match between marks on the envelope portions of the envelope web and the documents to ensure matching registration of documents and envelope portions of the envelope web, folding a first envelope flap of the envelope web adjacent one side of each document to contain the document within the folded envelope web with the first envelope flap having opposite ends in registration with other portions of the envelope web, folding a second envelope flap from the envelope web adjacent an opposite side of each document over the document and a portion of the first envelope flap, adhering the second envelope flap to a portion of the first envelope flap, securing the opposite ends of the first envelope flap and the registering other portions of the envelope web and cutting the envelope web containing the documents to form discrete envelopes each containing a document.

In a further preferred embodiment according to the present invention, there is provided a method for forming a mailer with a document contained therein from a single web of paper advancing in a longitudinal direction, comprising the steps of imaging indicia in side-by-side relation along the web representing respective document and envelope information, slitting the web in the longitudinal direction to form document and envelope-forming webs, cutting the document-forming web into discrete documents, folding the documents, registering the documents and envelope web with one another, applying cross-web adhesive to the envelope web at spaced longitudinal locations therealong defining discrete envelope-forming portions thereof, folding the envelope portion of the envelope web adjacent one side of each document to form a first flap to contain the document within the folded envelope web, folding the envelope portion of the envelope web adjacent an opposite side of each document to form a second flap overlying the document and portions of the first flap, adhering the second flap and portions of the first flap to one another, securing opposite ends of the envelope portions of the envelope web to one another and cutting the envelope web containing the documents into discrete envelopes each containing a document.

In a still further preferred embodiment according to the present invention, there is provided apparatus for forming a mailer with a document contained therein from a single web of paper advancing in a longitudinal direction, comprising a printer for printing indicia in side-by-side relation along the web representing respective document and envelope information, a slitter for slitting the web in the longitudinal direction to form discrete envelope and document webs, a cutter for cutting the document web into discrete documents, a folder for folding the document about at least one foldline transverse to the direction of web advance, means for rotating the folded document about 90° and registering it with the envelope web, a first plow folder for folding a portion of the envelope web adjacent one side of each document to contain the document within the folded envelope web portion, a second plow folder for folding the envelope web adjacent an opposite side of each document over the document and the first plow-folded portion, a sealer for adhering the folded portions of the envelope web to one another and end portions of the folded web to one another adjacent opposite ends of the document and a cutter for severing the envelope web between discrete envelope portions thereof to form discrete envelopes each containing a document.

Accordingly, it is a primary object of the present invention to provide novel and improved apparatus and methods for automatically making a personalized mailer sealed about a document from a single web of paper with variable and non-variable information imaged on both matching documents and envelopes.

BEST MODE FOR CARRYING OUT THE INVENTION

Figure 1A:
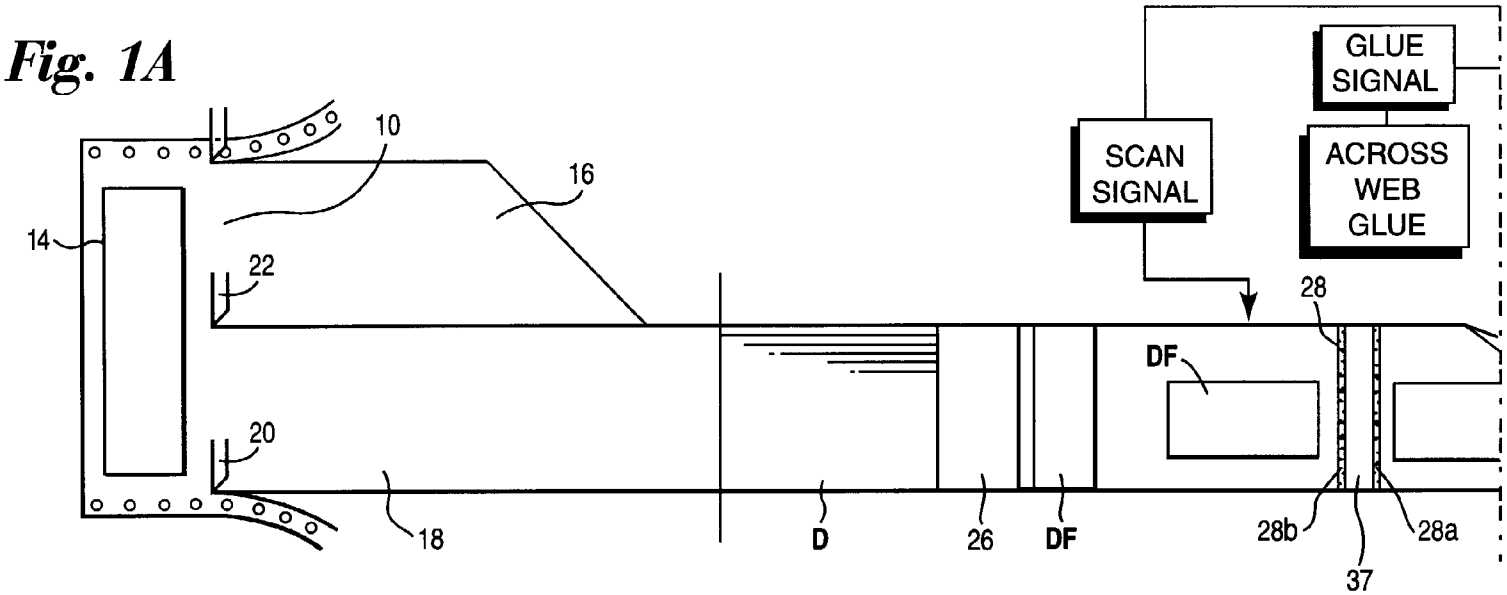
FIG. 1A is a schematic plan view of a portion of the document and envelope-making apparatus of the present invention.
Figure 2A:
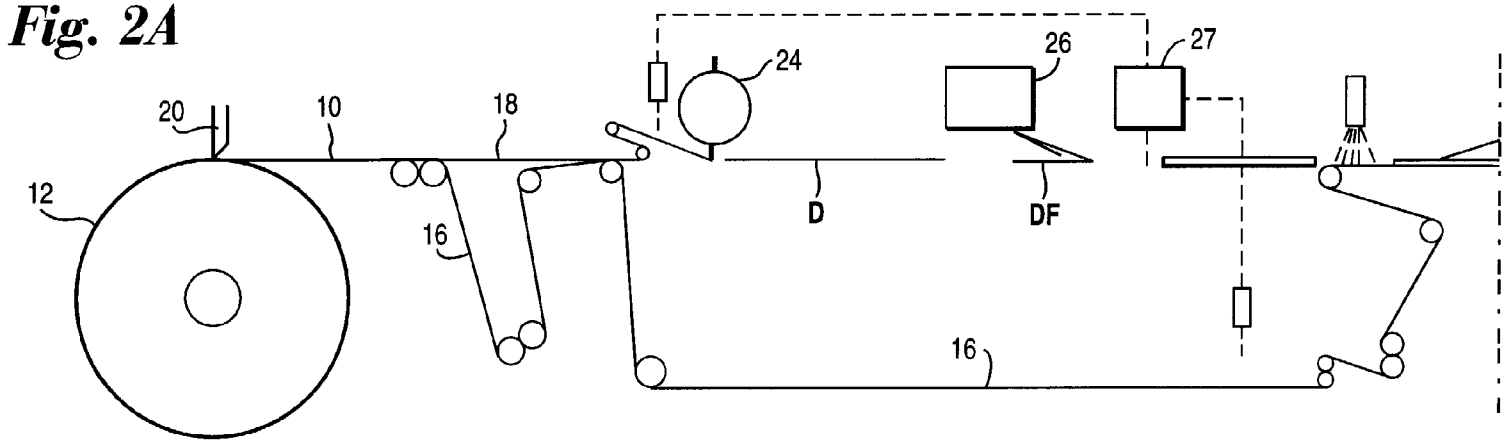
FIG. 2A is a schematic side elevational view of the document and envelope-making apparatus of FIG. 1A.

Referring now to the drawings, particularly to FIG. 1A, there is illustrated a web of paper taken from a roll 12 of paper and which web is passed through a printer, schematically illustrated at 14. The printer may be of any type, for example, a laser printer, and may be used to print both variable and non-variable information on the web 10. From a review of FIG. 1A, it will be appreciated that the web is imaged in a two-up side-by-side relation with one side forming an envelope web 16 and another side forming a document web 18. Thus, variable and/or non-variable information may be printed on each of the envelope and document webs 16 and 18, respectively, as desired. As illustrated, the web 10 may have tractor holes in strips along opposite sides of the web and which strips are cut from the web 10 by side slitters 20. A central slitter 22 also slits the web longitudinally to form the envelope web 16 and document web 18.

After the web 10 is imaged by the printer 14 and slit by slitters 20 and 22, the document and envelope web portions are separated from one another, with the envelope portion 16 extending below the document web 18. The envelope web 16 is shifted laterally by a web shift device, not shown, to lie vertically below the document web 18. The document and envelope webs are also provided with marks, e.g., by printing corresponding symbologies on the web, to match the envelope portions of the envelope web and the document portions of the document web such that the document portions subsequently cut to form discrete documents with variable and/or non-variable information imaged thereon will match the envelope portions of the envelope web with matching variable and non-variable information printed thereon. Any number of various optical scanning devices for scanning marks on the webs can be employed to ensure that the document and envelope portions match one another when each document is enveloped by its associated matching envelope.

The document web 18 is passed through a cutter 24 wherein the document web is cut to form discrete documents D. The documents are then passed through a folder, which may be any one of various types of folding mechanisms, for example, a C-folder, Z-folder or bi-folder. In the illustrated form, a C-folder 26 is provided whereby the document D is folded about foldlines transverse to the direction of travel of the document web to form a C-folded document. For example, where the documents are typically of a size 8½×11 inches and the long dimension of the document extends in the direction of web travel, the document is folded about foldlines extending laterally, i.e., in the width dimension of the document, with the result that the document may extend in the longitudinal direction after folding approximately 3.8 inches. The folded document is indicated at DF. It will be appreciated that because the document and envelope webs are initially formed from a single web in side-by-side relation to one another, the envelope web thus has a similar 8½×11-inch dimension, with the 11-inch dimension extending in the direction of travel of the web. Commercial C-folders are available from a variety of vendors, including Pitney Bowes and Bell & Howell.

The folded document DF is then oriented for proper presentation to a corresponding portion of the envelope web, i.e., the envelope portion of the envelope web having corresponding marks thereby matching each document with its corresponding envelope portion of the envelope web. Thus, as illustrated in FIG. 1A, the folded document DF is rotated approximately 90° by document rotating means 27 such that its width dimension aligns with the longitudinal direction of travel of the envelope web. That is, in the example given of an 8½×11 document, the 8½-inch dimension is aligned in the longitudinal direction of travel of the envelope web 16. Document and envelope webs are optically scanned to ensure that a match between the marks is obtained so that the document, e.g., containing variable information such as personalized information, is matched to the envelope portion having corresponding personalized information. The optical scanner serves three functions. First, it assures that the enveloping page which usually contains variable imaging information such as recipient address matches the content document. This is achieved by a comparison match of a symbology such as a bar code or OCR field on the enveloping page with a corresponding piece of information, which could be in a different symbology, on the document either directly or via a database lookup. If there is a mismatch, e.g., which could occur if a web section was out of synchronization due to operator setup error or component failure, or duplicate or a missing document is detected, the incident could be registered in a database and would place a physical visual mark on the document and envelope segments in error to facilitate diverting (extracting) the document from the output stream. Such marks could include spraying a bright-colored ink with an air-brush type device such as indicated by the functional element "spray divert mark" in FIG. 1B. Other marks may include printing an ultraviolet mark or other type that could be operator-detected and sensor-detected to actuate devices such as audible alarm, visual alarm such as blinking light and/or a device such as a solenoid-actuated kicker lever to assist the operator in extraction of the envelope and document from the output stream. Additionally, the scanner serves to track the documents and may also serve to ensure print quality. Commercial intelligent vision scanning systems such as Form Scan, Inspectron or Intelevision can be integrated into the present invention to provide this function.

A cross-web glue pattern 28 is applied to the envelope web 16 between the ends of the folded and rotated documents DF. Preferably, the pattern, in the form of a pair of longitudinally spaced adhesive strips, is provided on the envelope web between the ends of longitudinally adjacent folded document DF. Thus, the leading transversely extending adhesive strip 28*a* will form the seal for the trailing end of the leading envelope and the trailing transversely extending adhesive strip 28*b* will form the seal for the leading end of the trailing envelope. The area of the envelope web between the adhesive strips 28*a* and 28*b* form a chip which will be cut away and discarded as described below.

Figure 1B:
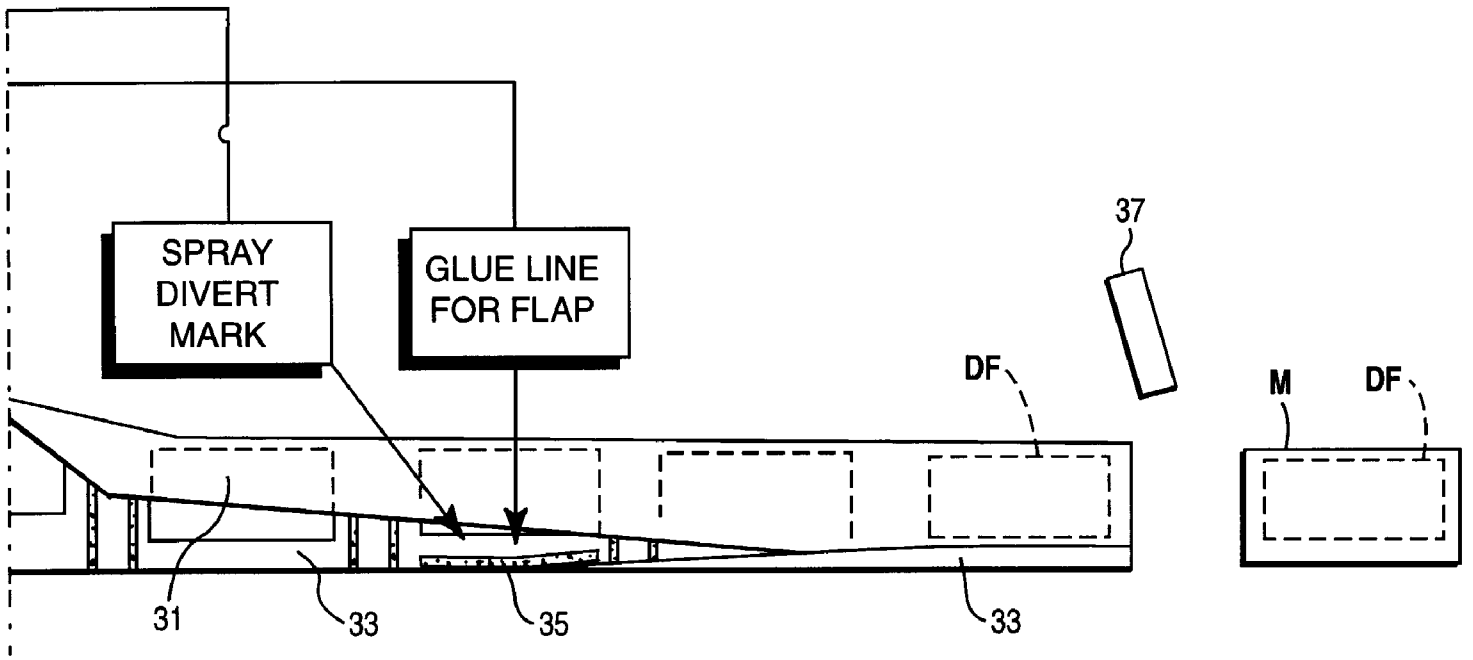
FIG. 1B is a longitudinal continuation of the apparatus of FIG. 1A.
Figure 2B:
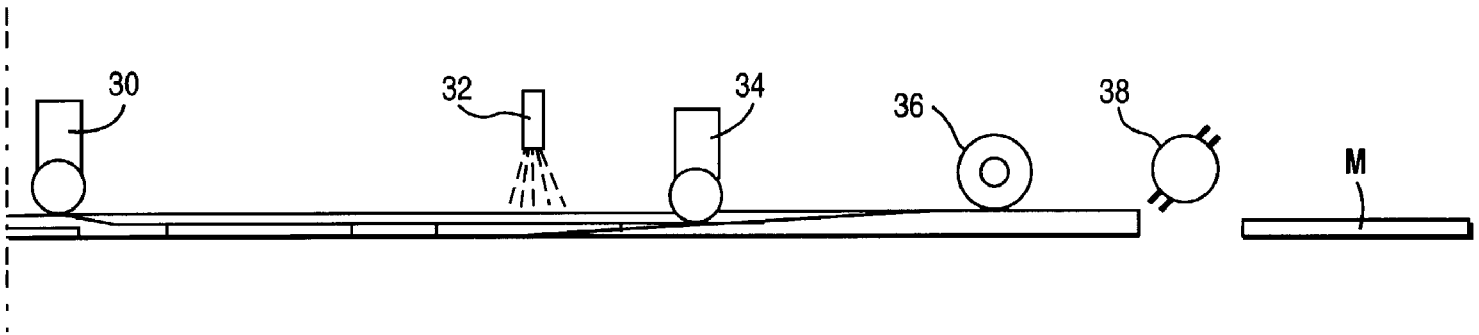
FIG. 2B is a continuation of the apparatus of FIG. 2A.

With the document DF registered with a corresponding envelope portion of the envelope web, the envelope web with the folded document is thereon is passed through a first folder 30 (FIG. 2B). Folder 30 is preferably a plow folder such that one side of the envelope web forms a first envelope flap 31 which is folded over the folded document DF to contain the document within the folded envelope web 16. The first flap 31 is folded from an envelope web portion along a longitudinally extending foldline adjacent one side of the folded document DF. By folding over the first envelope flap 31, it will be appreciated that the opposite ends of the envelope portion of the envelope web 16 are registered with one another along the adhesive lines 28. As illustrated in FIGS. 1B and 2B, after the first longitudinal envelope flap 31 is folded over, a line of adhesive 35 for a second flap 33 is applied by an adhesive applicator 32. The second line of adhesive may be applied to the margin of the first folded flap 31 or to the margin of the second flap 33. A second plow folder 34 folds the second envelope flap 33 from a second envelope web portion along a longitudinally extending foldline adjacent an opposite side of the document over the document and a portion of the first envelope flap. Thus, the adhesive applied to the second flap 33 overlies marginal portions of the first envelope flap.

Subsequently, with the first and second envelope flaps folded over to contain the document within the envelope portion and the envelope end portions in registration with one another, a sealer 36 secures the flaps to one another and the end portions of the envelopes to one another to fully enclose the document within the envelope portions of the web. It will be appreciated that many different types of adhesives can be used and preferably a permanent, heat-sealable adhesive is employed. Also, the adhesive lines 28 and 35 on the flaps and transversely on the envelope web portions, respectively, may be applied simultaneously and at different locations along the mailer production line.

With the documents fully enclosed within the envelope portions of the envelope web, the envelope web may be severed to form separate mailers M. Because the length dimension of the envelope portion is much longer than the corresponding dimension of the document within the envelope web portion, it is desirable and, for postal regulation purposes necessary, to shorten the length of the envelope. This is accomplished by cutting out the portion, i.e., chip 37, of the envelope web between the adjacent transverse adhesive lines 28*a* and 28*b*. For this purpose, a dual-blade rotary cutter 38 is provided for cutting chips 37 from the envelope web between the transverse adhesive lines 28*a* and 28*b* such that an appropriate length of envelope can be provided. The cutout chip 37 is then discarded.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for forming a mailer with a document contained therein from a single web of paper advancing in a longitudinal direction, comprising the steps of:

imaging indicia in side-by-side relation along the web representing respective document and envelope information;

providing marks on said respective sides of the web for identifying matching documents and envelope portions on the web;

slitting the web in the longitudinal direction to form document and envelope webs, respectively, with the envelope web carrying the envelope portions;

cutting the document-forming web into discrete documents;

folding said documents;

rotating each folded document prior to registering the documents with the envelope portions of the envelope web;

registering the documents and envelope web with one another;

determining a match between marks on the envelope portions of said envelope web and said documents to ensure matching registration of documents and envelope portions of the envelope web;

folding a first envelope flap of the envelope web about a foldline extending in the longitudinal direction of envelope web travel and adjacent one side of a document to contain the document within the folded envelope web with the first envelope flap having opposite ends in registration with other portions of the envelope web;

folding a second envelope flap from the envelope web about a foldline extending in the longitudinal direction of envelope web travel and adjacent an opposite side of each document over the document and a portion of the first envelope flap;

adhering the second envelope flap to a portion of the first envelope flap;

securing the opposite ends of the first envelope flap and the registering other portions of the envelope web; and cutting the envelope web containing the documents to form discrete envelopes each containing a document.

2. A method according to claim 1 including cutting the envelope web with the documents contained within the envelope portions to a predetermined size leaving said excess material between the envelope portions and discarding chips.

3. A method according to claim 1 wherein the step of folding includes buckle-folding.

4. A method according to claim 1 wherein the step of folding includes Z-folding.

5. A method according to claim 1 wherein the step of folding includes forming a bi-fold.

6. A method according to claim 1 wherein the web has feed holes in strips along opposite side edges thereof and including the step of trimming the strips from the web.

7. A method according to claim 1 wherein the documents and envelope portions of the document and envelope-forming webs having longitudinal dimensions in the longitudinal direction of advance of the web in excess of respective transverse dimensions thereof, and including folding each document about at least one foldline transverse to the longitudinal direction.

8. A method according to claim 1 including applying cross-web adhesive to said envelope web between discrete envelope portions thereof.

9. A method according to claim 1 wherein the step of folding the first and second envelope flaps includes plow folding said flaps.

10. A method according to claim 7 including applying cross-web adhesive to said envelope web between discrete envelopes, the step of folding the first and second envelope flaps including plow folding said flaps.

11. A method for forming a mailer with a document contained therein from a single web of paper advancing in a longitudinal direction, comprising the steps of:

imaging indicia in side-by-side relation along the web representing respective document and envelope information;

slitting the web in the longitudinal direction to form document and envelope-forming webs;

cutting the document-forming web into discrete documents;

folding said documents;

rotating each folded document prior to registering the documents with the envelope portions of the envelope web;

registering the documents and envelope web with one another;

applying cross-web adhesive to said envelope web at spaced longitudinal locations therealong defining discrete envelope-forming portions thereof;

folding the envelope portion of the envelope web adjacent one side of each document to form a first flap to contain the document within the folded envelope web;

folding the envelope portion of the envelope web adjacent an opposite side of each document to form a second flap overlying the document and portions of the first flap;

adhering the second flap and portions of the first flap to one another;

securing opposite ends of the envelope portions of the envelope web to one another; and cutting the envelope web containing the documents into discrete envelopes each containing a document.

12. A method according to claim 11 including applying separate strips of cross-web adhesive to the envelope web between discrete envelope portions thereof and cutting the envelope web between the strips forming chips and discarding the chips.

13. A method according to claim 11 wherein the step of folding the documents includes folding the document along at least one foldline extending transversely to the direction of advance of the web, and the step of folding the envelope web portions to form first and second flaps includes folding the flaps about foldlines extending in the direction of advance of the web.

14. A method according to claim 1 wherein the step of folding includes C-folding.

* * * * *